US009850900B2

(12) United States Patent
Mao et al.

(10) Patent No.: US 9,850,900 B2
(45) Date of Patent: Dec. 26, 2017

(54) ROTARY COMPRESSOR AND ROTATION MECHANISM

(75) Inventors: Chunzhi Mao, Suzhou (CN); Xiaogeng Su, Suzhou (CN); Qingwei Li, Suzhou (CN); Qiang Liu, Suzhou (CN); Hongshan Li, Suzhou (CN)

(73) Assignee: Emerson Climate Technologies (Suzhou) Co., Ltd., Jiangsu (CN)

( * ) Notice: Subject to any disclaimer, the term of this patent is extended or adjusted under 35 U.S.C. 154(b) by 277 days.

(21) Appl. No.: 14/112,188

(22) PCT Filed: Apr. 18, 2012

(86) PCT No.: PCT/CN2012/074247

§ 371 (c)(1),
(2), (4) Date: Oct. 16, 2013

(87) PCT Pub. No.: WO2012/142944

PCT Pub. Date: Oct. 26, 2012

(65) Prior Publication Data

US 2014/0044581 A1 Feb. 13, 2014

(30) Foreign Application Priority Data

Apr. 18, 2011 (CN) ..... 2011 1 0104725
Apr. 18, 2011 (CN) ..... 2011 2 0124863 U

(51) Int. Cl.
*F04C 15/00* (2006.01)
*F04C 29/02* (2006.01)
(Continued)

(52) U.S. Cl.
CPC ..... *F04C 15/0092* (2013.01); *F04B 9/125* (2013.01); *F04B 49/03* (2013.01);
(Continued)

(58) Field of Classification Search
CPC .. F04C 15/0092; F04C 29/025; F04C 29/023; F04C 28/28; F04C 23/008;
(Continued)

(56) References Cited

U.S. PATENT DOCUMENTS 3,411,313 A 11/1968 Brown et al.
3,552,433 A * 1/1971 Mason ..... F15B 20/008 137/553
(Continued)

FOREIGN PATENT DOCUMENTS

CN 1242478 A 1/2000
CN 1740571 A 3/2006
(Continued)

OTHER PUBLICATIONS

First Chinese Office Action regarding Application No. 201110104725.1, dated Jun. 26, 2014. Translation provided by Unitalen Attorneys at Law.
(Continued)

*Primary Examiner* — Devon Kramer
*Assistant Examiner* — Christopher Brunjes
(74) *Attorney, Agent, or Firm* — Harness, Dickey & Pierce, P.L.C.

(57) ABSTRACT

A rotary compressor, comprising: a housing, comprising a lubricant oil storage part for containing lubricating oil; a compression mechanism disposed in the housing; a driving mechanism driving the compression mechanism, the driving mechanism comprising a rotation shaft, through-holes extending along the axial direction of the rotating shaft are disposed inside the rotating shaft, and the rotation shaft is in fluid connection with the lubricating oil storage part via the through-holes; and an oil level sensor in fluid connection with the through-holes inside the rotation shaft via a pressurized collection channel. Also disclosed is a rotation
(Continued)

mechanism, comprising an oil level sensor in fluid connection with the through-holes inside the rotation shaft via the pressurized collection channel. Accurate and reliable detection of the lubricating oil in a compressor can be done using the pressurized collection channel and the oil level sensor, thus greatly saving cost and improving compressor reliability.

37 Claims, 7 Drawing Sheets

(51) Int. Cl.

| | |
|---|---|
| ***F04B 49/03*** | (2006.01) |
| ***F04B 9/125*** | (2006.01) |
| ***F04C 23/00*** | (2006.01) |
| ***F04C 28/28*** | (2006.01) |
| *F04C 18/02* | (2006.01) |

(52) U.S. Cl.
CPC ..... *F04C 23/008* (2013.01); *F04C 28/28* (2013.01); *F04C 29/023* (2013.01); *F04C 29/025* (2013.01); *F04C 18/0215* (2013.01); *F04C 2240/809* (2013.01); *F04C 2240/81* (2013.01); *F04C 2270/24* (2013.01); *F04C 2270/48* (2013.01)

(58) Field of Classification Search
CPC ..... F04C 2270/24; F04C 2270/48; F04C 2240/81; F04C 2240/809; F04C 18/0215; F04B 9/125; F04B 9/03; G01L 7/16; G01L 7/163; G01L 13/02
USPC ..... 417/63, 410.5, 228
See application file for complete search history.

(56) References Cited

U.S. PATENT DOCUMENTS

| | | | | |
|---|---|---|---|---|
| 4,440,022 | A | 4/1984 | Masom | |
| 4,669,960 | A | 6/1987 | Allen, Jr. et al. | |
| 4,932,841 | A | 6/1990 | Havemann | |
| 5,256,042 | A | 10/1993 | McCullough et al. | |
| 6,082,972 | A | 7/2000 | Moore, Jr. et al. | |
| 6,276,901 | B1 * | 8/2001 | Farr | F04B 39/0253 340/619 |
| 7,179,069 | B2 | 2/2007 | Grassbaugh | |
| 2004/0013542 | A1 | 1/2004 | Sun | |
| 2004/0151604 | A1 | 8/2004 | Ishida et al. | |
| 2005/0011704 | A1 | 1/2005 | Barowsky et al. | |
| 2005/0108990 | A1 * | 5/2005 | Kahn | B65B 31/046 53/432 |
| 2006/0045784 | A1 | 3/2006 | Grassbaugh | |
| 2009/0068043 | A1 | 3/2009 | Su | |
| 2009/0068044 | A1 | 3/2009 | Guo et al. | |
| 2009/0068045 | A1 | 3/2009 | Su et al. | |
| 2009/0068048 | A1 * | 3/2009 | Stover | F04C 18/0215 418/55.4 |
| 2010/0280430 | A1 * | 11/2010 | Caleffi | A61M 1/342 604/5.01 |

FOREIGN PATENT DOCUMENTS

| | | | | |
|---|---|---|---|---|
| CN | 201206549 | Y | 3/2009 | |
| CN | 202091205 | U | 12/2011 | |
| DE | 3728239 | A1 * | 3/1989 | F01M 5/025 |
| DE | 3728239 | A1 | 3/1989 | |
| EP | 1408235 | A1 | 4/2004 | |
| EP | 1498608 | A1 | 1/2005 | |
| JP | S-60-93191 | A | 5/1985 | |
| JP | H03100395 | A | 4/1991 | |
| JP | H09317673 | A | 12/1997 | |
| KR | 20090071085 | A | 7/2009 | |

OTHER PUBLICATIONS

Cheng Dewei et al. "Experimental study on control logic of lubricant position in direct current inverter compressor under low ambient temperature." Cryogenics. No. 1, Sum No. 179. Feb. 15, 2011.

International Search Report (in Chinese with English translation) and Written Opinion (in Chinese) for PCT/CN2012/074247, dated Aug. 2, 2012; ISA/CN.

European Search Report for PCT/CN2012074247 dated Oct. 30, 2014.

* cited by examiner

ROTARY COMPRESSOR AND ROTATION MECHANISM

The present application is the national phase of International Application No. PCT/CN2012/074247, titled "ROTARY COMPRESSOR AND ROTARY MECHANISM", filed on Apr. 18, 2012, which claims the priorities to Chinese patent application No. 201110104725.1 titled "ROTARY COMPRESSOR AND ROTARY MACHINE", filed with the Chinese State Intellectual Property Office on Apr. 18, 2011 and Chinese patent application No. 201120124863.1 titled "ROTARY COMPRESSOR AND ROTARY MACHINE", filed with the Chinese State Intellectual Property Office on Apr. 18, 2011. The entire disclosures thereof are incorporated herein by reference.

FIELD OF THE INVENTION

The present disclosure relates to a rotary compressor and a rotary machine.

BACKGROUND OF THE INVENTION

The rotary compressor generally comprises a shell, a compressing mechanism disposed in the shell, a driving mechanism for driving the compressing mechanism and so on. In order to ensure the normal operation of the compressor, there must be sufficient lubricating oil in the compressor. The lubricating oil level in the compressor should be higher than a lowest protection lubricating oil level. When the lubricating oil level in the compressor is lower than the lowest protection lubricating oil level, the compressor should be shut off.

A twin compressor system or even a multiple compressor system has been used widely. In this kind of twin or multiple compressor system, one or more of the compressors may be activated selectively and the others may be shut off, therefore lubricating oil would move in these compressors which may cause lubricating oil unbalance among compressors, even results in a situation that some compressors lack of lubricating oil.

In addition, lacking of lubricating oil may occur due to oil leakage in the compressor or oil leakage in the compressor system consisting of a single compressor or a plurality of compressors.

Furthermore, in the large refrigeration system having long pipeline and a great number of components, the lubricating oil may be unable to circulate back to the compressor in time, which causes lubricating oil shortage in the compressor.

As a result, the lubricating oil status (for example, height of lubricating oil level) in the compressor must be detected accurately to shut off the compressor timely and prevent the compressor from being damaged.

SUMMARY OF THE INVENTION

Technical Problems to be Solved

However, most of the compressors have no built-in oil level sensor presently.

Although there are some liquid level sensors for detecting liquid level, these liquid level sensors are only suitable for detecting the liquid level in an oil tank or in a container. These sensors includes: piezoelectric liquid level sensor, reed switches liquid level sensor, ultrasonic liquid level sensor, photoelectric liquid level sensor and so on. The above mentioned sensors generally cannot be used in a hermetic compressor, since the working environment within the hermetic compressor is rigorous. For example, the ranges of the temperature and the pressure within the compressor are wide, and the pressure and the temperature would cycle, and there may be cast impurity etc. In addition, lubricating oil foam may be formed in the compressor. Therefore, these sensors cannot detect height of lubricating oil level accurately.

Accordingly, there is a need for a rotary compressor which can detect lubricating oil in the compressor more simply and reliably.

Technical Solutions

An object of one or more embodiments of the disclosure is to provide a rotary compressor which can detect lubricating oil within the compressor simply and reliably.

Another object of one or more embodiments of the disclosure is to provide a rotary machine which can detect lubricating oil within the rotary machine simply and reliably.

One aspect of the description provides a rotary compressor, comprising a shell including an oil sump for receiving lubricating oil; a compressing mechanism disposed in the shell; a driving mechanism for driving the compressing mechanism, the driving mechanism includes a rotary shaft provided therein with a through hole extending in an axial direction of the rotary shaft and the rotary shaft is in fluid communication with the oil sump via the through hole; and an oil level sensor in fluid communication with the through hole in the rotary shaft through a pressure picking passage.

Preferably, the rotary compressor further comprises a lower bearing housing for supporting the rotary shaft, wherein the pressure picking passage comprises a pressure picking hole extending through a side wall of the rotary shaft and in fluid communication with the through hole in the rotary shaft, a circumferential oil groove formed on the rotary shaft or the lower bearing housing and in fluid communication with the pressure picking hole, and a communicating channel extending through the lower bearing housing and in fluid communication with the circumferential oil groove and the oil level sensor.

Preferably, the rotary compressor further comprises a pressure picker disposed between the rotary shaft and the oil level sensor, wherein the pressure picking passage comprises a pressure picking hole extending through a side wall of the rotary shaft and in fluid communication with the through hole in the rotary shaft, a circumferential oil groove formed on the rotary shaft or the pressure picker and in fluid communication with the pressure picking hole, and a communicating channel extending through the pressure picker and in fluid communication with the circumferential oil groove and the oil level sensor.

Preferably, the pressure picking passage further comprises a pressure picking pipe disposed in the pressure picking hole and protruded toward an axis of the through hole in the rotary shaft.

Preferably, a length of the pressure picking pipe is determined according to a lowest protection lubricating oil level in the oil sump.

Preferably, the higher the lowest protection lubricating oil level is set, the longer the length of the pressure picking pipe is set.

Preferably, the lowest protection lubricating oil level and the length of the pressure picking pipe satisfy the following equation:

$$H = h - \frac{(R-L)^2 \cdot \left(\frac{n}{60} \cdot 2\pi\right)^2}{2000 \cdot g},$$

wherein, H [mm] is a height of the lowest protection lubricating oil level from an end face of the rotary shaft; L[mm] is a length of the pressure picking pipe protruded into the rotary shaft; R [mm] is an inner radius of the rotary shaft; h [mm] is a height of a central axis of the pressure picking pipe from the end face of the rotary shaft; n [rpm] is the number of revolution of the rotary shaft; g [$m/s^2$] is the acceleration of gravity.

Preferably, a height of the pressure picking hole from a certain reference surface (S) is determined according to the lowest protection lubricating oil level in the oil sump.

Preferably, the higher the lowest protection lubricating oil level is set, the higher the height of the pressure picking hole is set.

Preferably, the reference surface is a bottom surface of the rotary compressor or an end surface of the rotary shaft.

Preferably, the rotary compressor further comprises an oil pumping mechanism which includes a plate with a hole provided at an end of the rotary shaft and an oil fork provided in the through hole of the rotary shaft.

Preferably, the oil pumping mechanism includes a vane pump provided at an end of the rotary shaft.

Preferably, the rotary compressor is a horizontal rotary compressor and an inner space of the rotary compressor is divided into high side acting as the oil sump and low side by a muffler plate, and the oil pumping mechanism is an oil pipe extending from the oil sump to the through hole in the rotary shaft.

Preferably, the through hole comprises a concentric hole portion which is concentric with respect to the rotary shaft and an eccentric hole portion which is offset radially with respect to the concentric hole.

Preferably, the oil level sensor is a pressure sensor.

Preferably, the oil level sensor is a pressure switch.

Preferably, the oil level sensor comprises: a fluid pressure receiving portion for receiving pressure of fluid; and a converting portion for converting the pressure of fluid into an electrical signal.

Preferably, the fluid pressure receiving portion comprises a housing and a piston head which is movable axially in the housing; the converting portion comprises a terminal plug, a first contact and a second contact provided in the terminal plug, a spring for providing electrical connection between the piston head and the second contact and providing return force for the piston head, wherein the oil level sensor outputs the electric signal when the piston head contacts the first contact.

Preferably, the first contact comprises a plurality of pins which are spaced with each other.

Preferably, the second contact comprises an annular contact lug electrically contacted with the spring.

Preferably, the rotary compressor further comprises an oil temperature sensor.

Preferably, the oil temperature sensor and the oil level sensor have a common lead wire.

Preferably, the oil level sensor is provided near the lower bearing housing.

Preferably, the oil level sensor is directly connected with the communicating channel in the lower bearing housing or in the pressure picker.

Preferably, the oil level sensor is connected with the communicating channel in the lower bearing housing or in the pressure picker through an additional pipeline.

Preferably, the rotary compressor is a scroll compressor, or a screw compressor, or a rotor compressor.

Preferably, the oil level sensor is disposed inside the shell or outside the shell.

Preferably, when the oil level sensor is disposed outside the shell, the pressure picking passage further comprises a connecting pipe in fluid communication with the communicating channel in the lower bearing housing or in the pressure picker.

Preferably, the connecting pipe is arranged horizontally or obliquely.

Another aspect of the disclosure provides a rotary machine, comprising a shell including an oil sump for receiving lubricating oil; a rotary shaft disposed in the shell, wherein the rotary is provided therein with a thorough hole extending in an axial direction of the rotary shaft and the rotary shaft is in fluid communication with the oil sump via the through hole; and an oil level sensor in fluid communication with the through hole in the rotary shaft through a pressure picking passage.

Preferably, the rotary machine further comprises a bearing housing for supporting the rotary shaft, wherein the pressure picking passage comprises a pressure picking hole extending through a side wall of the rotary shaft and in fluid communication with the through hole in the rotary shaft, a circumferential oil groove formed on the rotary shaft or the bearing housing and in fluid communication with the pressure picking hole, and a communication channel extending through the bearing housing and in fluid communication with the circumferential oil groove and the oil level sensor.

Preferably, the rotary machine further comprises a pressure picker disposed between the rotary shaft and the oil level sensor, wherein the pressure picking passage comprises a pressure picking hole extending through a side wall of the rotary shaft and in fluid communication with the through hole in the rotary shaft, a circumferential oil groove formed on the rotary shaft or the pressure picker and in fluid communication with the pressure picking hole, and a communicating channel extending through the pressure picker and in fluid communication with the circumferential oil groove and the oil level sensor.

Technical Effects

The advantages of the rotary compressor and the rotary machine according to one or more embodiments of the present disclosure are as follows:

The compressor or the rotary machine is provide therein with an oil level detecting mechanism, therefore lubricating oil in the compressor or the rotary machine can be detected timely, accurately and reliably to prevent or reduce the damage of the compressor or the rotary machine due to insufficient lubricating oil.

The oil level detecting mechanism may include an oil level sensor and a pressure picking passage in fluid communication with the through hole in the rotary shaft, and the oil level sensor may be a pressure sensor or a pressure switch. Thereby, the oil level detecting mechanism may have a relatively simple configuration and may be machined easily, which reduces the cost of the compressor or the rotary machine.

In one or more embodiments of the disclosure, the lubricating oil in the compressor or the rotary machine can be detected more easily and reliably by converting the oil level detecting in the compressor or the rotary machine into hydraulic pressure detecting. And the expensive liquid level sensor can be replaced by a pressure sensor or a pressure switch having simpler configuration and lower cost.

A lubricating oil level to be detected can be adjusted more easily by controlling the length of the pressure picking pipe or the height of the pressure picking hole. Therefore, it is applicable in various types or models of compressor or rotary machine more easily.

The oil level sensor in one or more embodiments of the disclosure has relatively simple configuration and low cost, but has high reliability and short response time.

The first contact of the oil level sensor includes a plurality of pins spaced with each other, and the ON signal may be output as long as any one of the pins contact the piston head. Therefore, the reliability of the oil level sensor is enhanced.

The oil level sensor may be disposed inside or outside the shell of the compressor, and the oil level sensor may communicate directly with the pressure picking passage or communicate with the pressure picking passage through an additional pipeline, thereby greatly facilitating the arrangements of the components in the compressor.

The rotary compressor in one or more embodiments of the present disclosure provides not only an oil level sensor but also an oil temperature sensor, thus can provide multi-protection for the compressor.

BRIEF DESCRIPTION OF THE DRAWINGS

The characteristics and advantages of one or more embodiments of the disclosure will become more apparent with reference to the description in conjunction with the accompanied drawings in which.

DETAILED DESCRIPTION

The following description of the preferred embodiments is only illustrative rather than limiting the present disclosure and application or use thereof.

Figure 1:
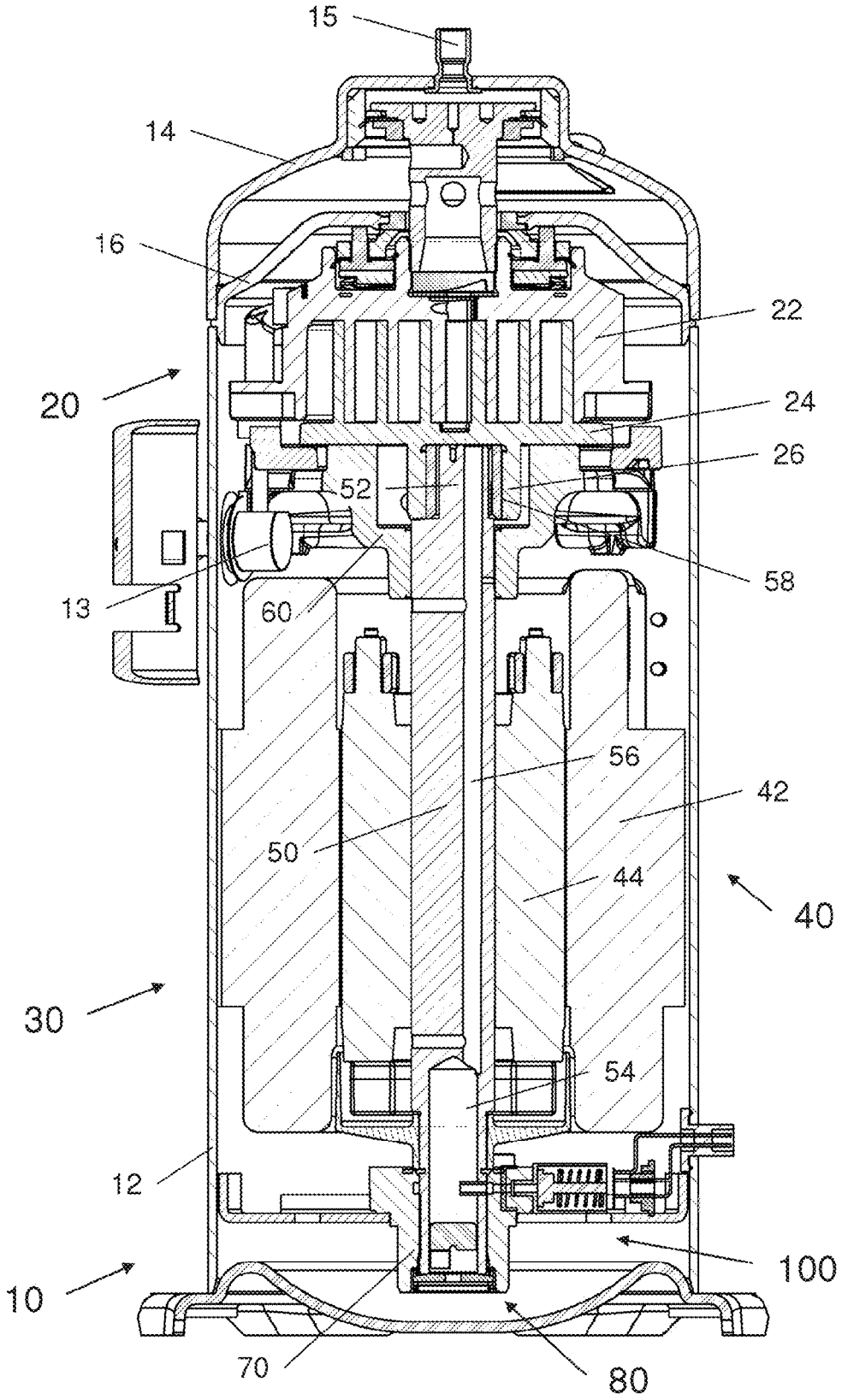
FIG. 1 is a schematic sectional view of the rotary compressor according to an embodiment of the disclosure.

The basic configuration of the rotary compressor according to the present disclosure will be described with reference to FIG. 1 hereinafter. FIG. 1 is a schematic sectional view of a rotary compressor according to an embodiment of the disclosure. The rotary compressor shown in FIG. 1 is a scroll compressor, however, it should be appreciated by those skilled in the art that the present disclosure is not limited to the scroll compressor as shown, but may be applicable in other types of compressor with a rotary shaft, such as a screw compressor, a rotor compressor and so forth, and any types of rotary machine with a rotary shaft. In addition, the present disclosure is applicable not only in a vertical compressor with a rotary shaft oriented vertically but in a horizontal compressor with a rotary shaft oriented horizontally.

The rotary compressor 10 includes a generally cylindrical shell 12. An inlet fitting 13 for sucking gaseous refrigerant in low pressure is provided on the shell 12. One end of the shell 12 is connected fixedly with an end cover 14. The end cover 14 is fitted with a discharging fitting 15 for discharging compressed refrigerant. A muffler plate 16 extending transversely relative to an axial direction of the shell 12 (approximately extending in the horizontal direction in FIG. 1) is provided between the shell 12 and the end cover 14, to divide an inner space of the compressor into a high side and a low side. The space between the end cover 14 and the muffler plate 16 acts as the high side space and the space between the muffler plate 16 and the shell 12 acts as the low side space. A part of the shell 12 functions as an oil sump for receiving lubricating oil. In the example shown in FIG. 1, the oil sump is located at a lower portion of the shell 12.

The shell 12 has a compressing mechanism 20 and a driving mechanism 30 housed therein. In the example shown in FIG. 1, the compressing mechanism 20 includes a non-orbiting scroll component 22 and an orbiting scroll component 24 which are engaged with each other. The driving mechanism 30 includes a motor 40 and a rotary shaft 50. The motor 40 includes a stator 42 and a rotor 44. The stator 42 is connected fixedly with the shell 12. The rotor 44 is connected fixedly with the rotary shaft 50 and rotates within the stator 42. The first end (the upper end in FIG. 1) of the rotary shaft 50 is provided with an eccentric crank pin 52 and the second end (the lower end in FIG. 1) of the rotary shaft 50 may includes a concentric hole 54. The concentric hole 54 extends to the eccentric crank pin 52 at the first end of the rotary shaft 50 via an eccentric hole 56 offset radially with respect to the concentric hole 54. The rotary shaft 50 is in fluid communication with the oil sump through the concentric hole 54.

The first end of the rotary 50 is supported by a main bearing housing 60 and the second end thereof is supported by a lower bearing housing 70. The main bearing housing 60 and the lower bearing housing 70 are connected fixedly to the shell 12 in proper ways. The eccentric crank pin 52 of the rotary shaft 50 is inserted into the hub 26 of the orbiting scroll component 24 via a bush 58 to rotatably drive the orbiting scroll component 24.

Figure 5:
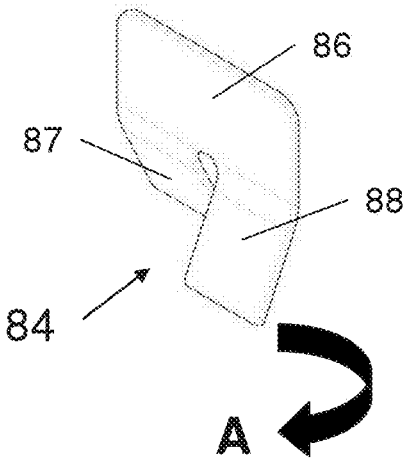
FIG. 5 is an oil fork provided in the rotary compressor according to the embodiment of the disclosure.

The second end (the lower end in FIG. 1) of the rotary shaft 50 may further be provided with an oil pumping mechanism 80. In the example shown in FIG. 1, the oil pumping mechanism 80 may include a plate with a hole 82 provided at the second end of the rotary shaft 50 and an oil fork 84 provided in the concentric hole 54 and rotating along with the rotary shaft 50. The plate with a hole 82 is approximately a disc with a through hole 83 provided centrally. FIG. 5 shows an example of the oil fork 84. As shown in FIG. 5, the oil fork 84 includes an approximately rectangular base 86, legs 87 and 88 extending in the same direction from the base 86 and branched. Planes on which the legs 87 and 88 lie are inclined with respect to a plane on which the base lies in a rotary direction A of the rotary shaft 50, respectively.

Figure 3:
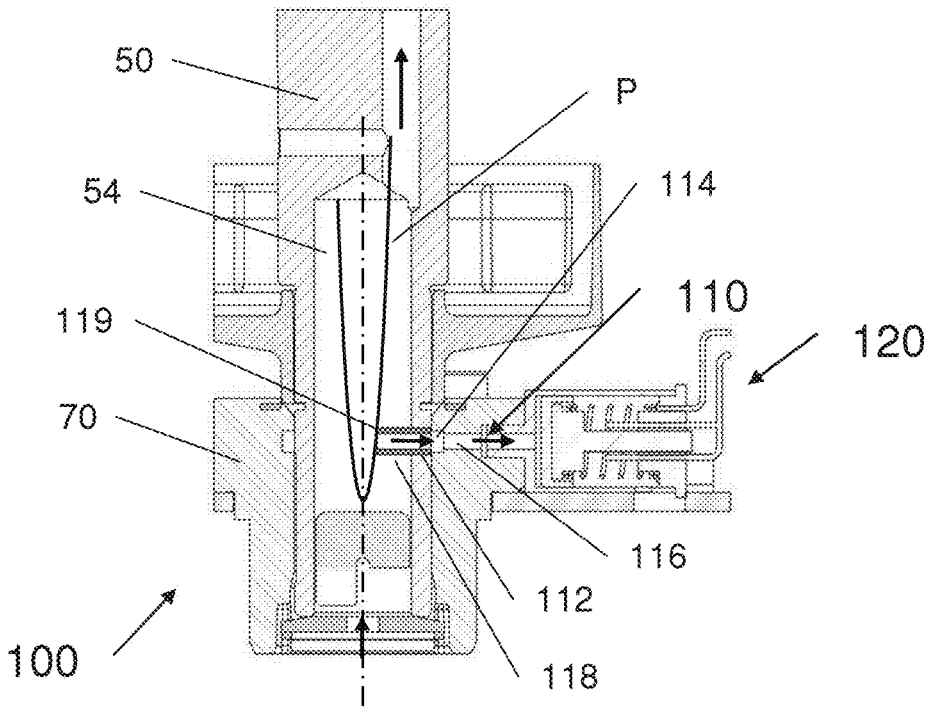
FIG. 3 is a schematic diagram of an oil level detecting mechanism according to the embodiment of the disclosure.

The lubricating oil in the lower portion of the shell 12 flows into the concentric hole 54 of the rotary shaft 50 through the through hole 83 of the plate with a hole 82 when the compressor operates. The lubricating oil flows radially from the center of the plate with a hole 82 to periphery of the plate with a hole 82 and an inner wall of the concentric hole 54 under the centrifugal force. Being brought by the legs 87 and 88 of the oil fork 83 rotating with the rotary shaft 50, the lubricating oil is pumped upwardly and forms a shape which is approximately a paraboloid P in the concentric hole 54, as shown in FIG. 3. And then, the lubricating oil flows into the eccentric hole 56 in fluid communication with the concentric hole 52 and arrives at an end of the eccentric crank pin 52. After being discharged from the end of the eccentric crank pin 52, the lubricating oil flows downwardly under the gravity and is splashed by various moving components and then lubricates and cools various moving components.

In the example shown in FIG. 1, the oil pumping mechanism consisting of the plate with a hole 82 and the oil fork 84 is used. However, those skilled in the art should understand that, the oil pumping mechanism is not limited to what described herein and may use any mechanisms that can supply lubricating oil to the concentric hole 54 of the rotary shaft 50. In addition, the oil pumping mechanism consisting of the plate with a hole 82 and the oil fork 84 shown in FIG. 1 may be replaced by a vane pump. Furthermore, in a horizontal compressor, an oil pipe extending from the high side to the concentric hole of the rotary shaft at the low side may be used as the oil pumping mechanism since most of the lubricating oil is stored in the high side (in this case, the high side acts as the oil sump described above), in this circumstance, the lubricating oil may be supplied by a pressure difference between the high side and the low side.

Besides, those skilled in the art should understand that, the compressing mechanism 20 and the driving mechanism 30 are not limited to the configurations shown in the figures. Instead, the compressing mechanism 20 may be a rotor compressing mechanism or a screw compressing mechanism and so forth, and the driving mechanism 30 may be a hydraulic driving mechanism, a pneumatic driving mechanism and various transmission driving mechanism provided inside the shell or outside the shell.

The following documents provide the other detailed information of the rotary compressor related to the embodiments of the present disclosure: CN201206549Y, US2009/0068048A1, US2009/0068045A1, US2009/0068044A1 and US2009/0068043A1. The entire disclosures of these documents are incorporated herein by reference.

There must be sufficient lubricating oil in the compressor so as to ensure the normal operation of the compressor. In other words, the compressor should be shut off when the amount of lubricating oil, for example, a height of a lubricating oil level, in the compressor is lower than a predetermined value, for example, a lowest protection lubricating oil level, to prevent the compressor from being damaged.

Figure 2:
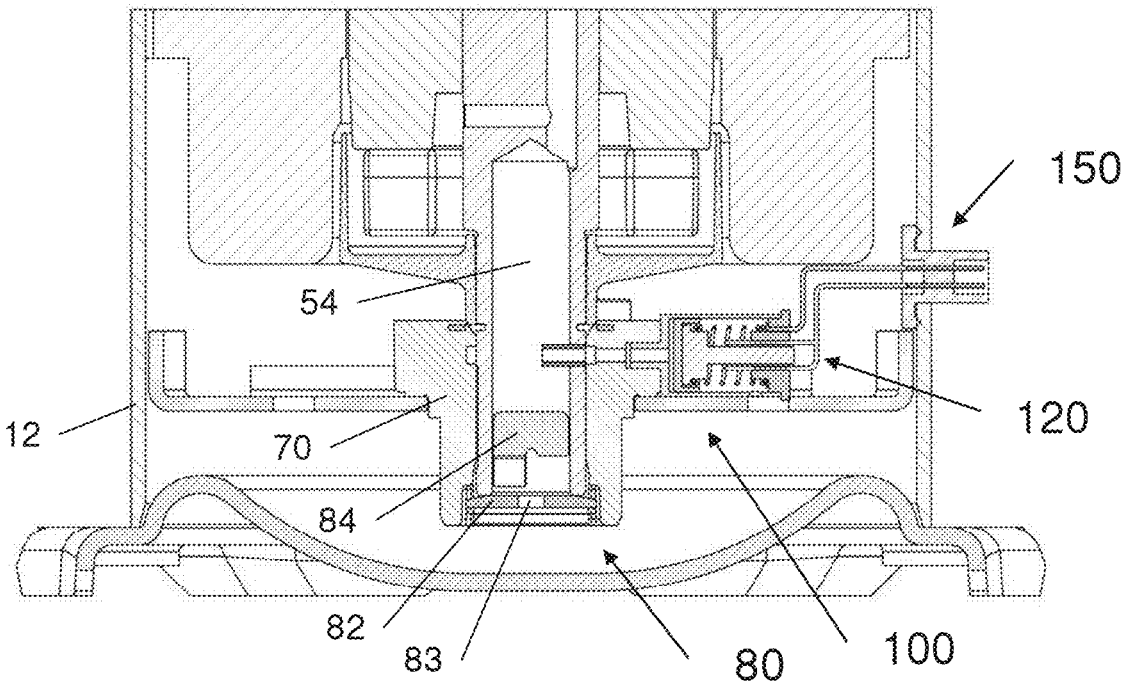
FIG. 2 is an enlarged view of a lower portion of the rotary compressor shown in FIG. 1.
Figure 4:
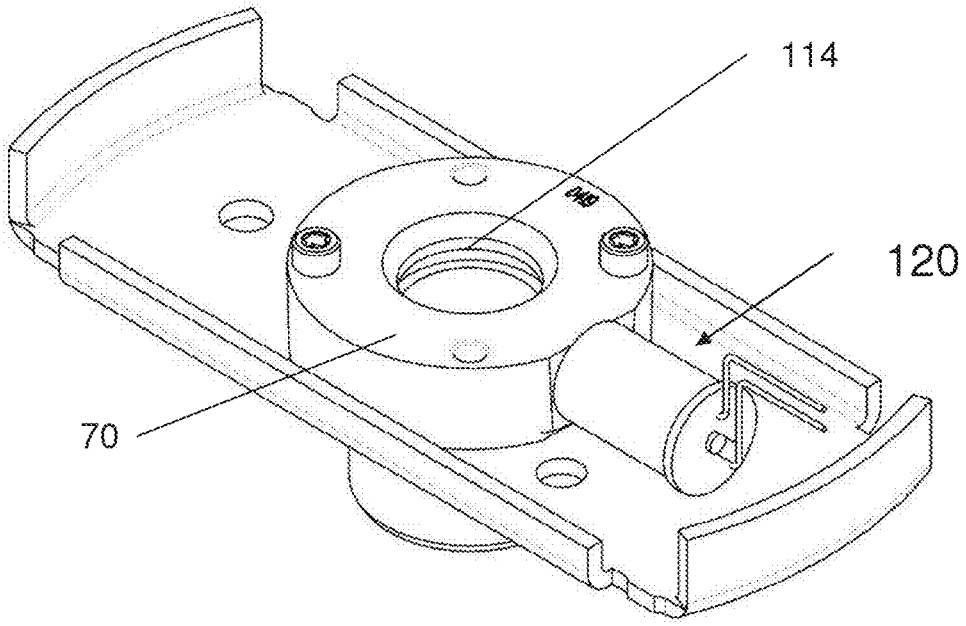
FIG. 4 is a perspective view of a lower bearing integrated with an oil level sensor according to the embodiment of the disclosure.

Hereinafter, an oil level detecting mechanism will be described with reference to FIGS. 1 to 8. FIG. 2 is an enlarged view of a lower portion of the rotary compressor in FIG. 1. FIG. 3 is a perspective view of an oil level detecting mechanism according to the embodiment of the present disclosure. FIG. 4 is a perspective view of a lower bearing integrated with an oil level sensor according to the embodiment of the present disclosure.

As shown in FIGS. 1 to 3, the rotary compressor 10 according to the embodiment of the present disclosure further includes an oil level detecting mechanism 100 provided in the compressor 10. The oil level detecting mechanism 100 according to the embodiment of the present disclosure may include an oil level sensor 120 in fluid communication with the concentric hole 54 of the rotary shaft 50 through a pressure picking passage 110. In the example shown in FIG. 3, the pressure picking passage 110 may include a pressure picking hole 112 extending through a side wall of the rotary shaft 50 in an approximately radial direction, a circumferential oil groove 114 provided in the lower bearing housing 70 and in fluid communication with the pressure picking hole 112 and a communicating channel 116 provided in the lower bearing housing 70 extending through the lower bearing housing 70 in an approximately radial direction and in fluid communication with the circumferential oil groove 114 and the fluid inlet 122 of the oil level sensor 120. The oil level sensor 120 may be provided at the lower bearing housing 70 or near the lower bearing housing 70. During the rotation of the rotary shaft 50, the pressure picking hole 112 on the rotary shaft 50 also be rotated. Since the circumferential oil groove 114 is provided corresponding to the rotation path of the pressure picking hole 112, the pressure picking hole 112 can always be in fluid communication with the circumferential oil groove 114, and in turn always be in fluid communication with the communicating channel 116, so as to introduce the fluid stably into the oil level sensor 120 connected therewith.

Figure 6:
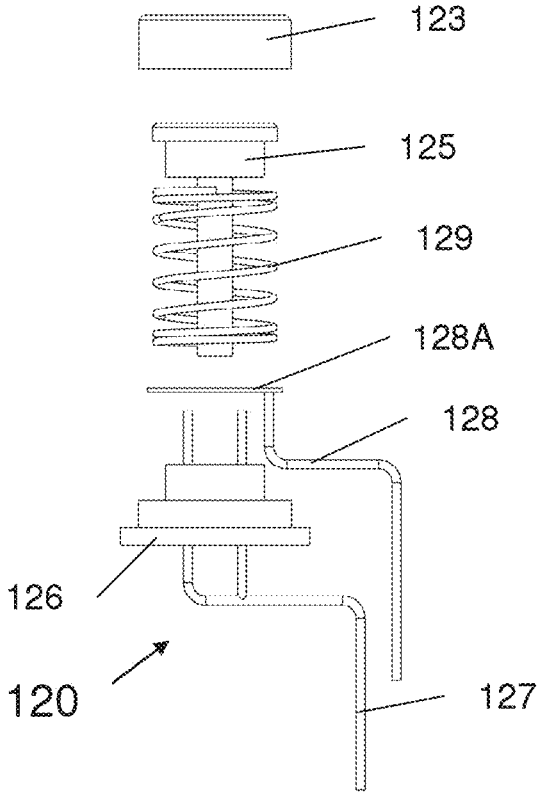
FIG. 6 is a front view of an oil level sensor according to the embodiment of the disclosure.
Figure 7:
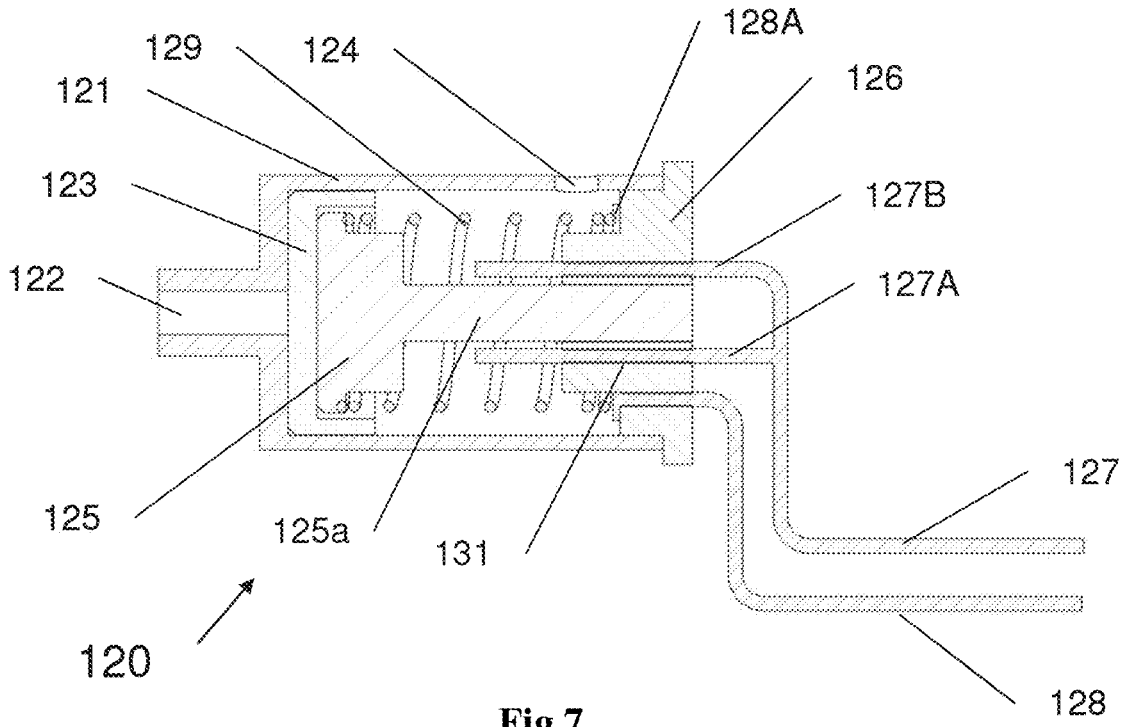
FIG. 7 is a sectional view of an oil level sensor according to the embodiment of the disclosure, showing the oil level sensor in an OFF status.
Figure 8:
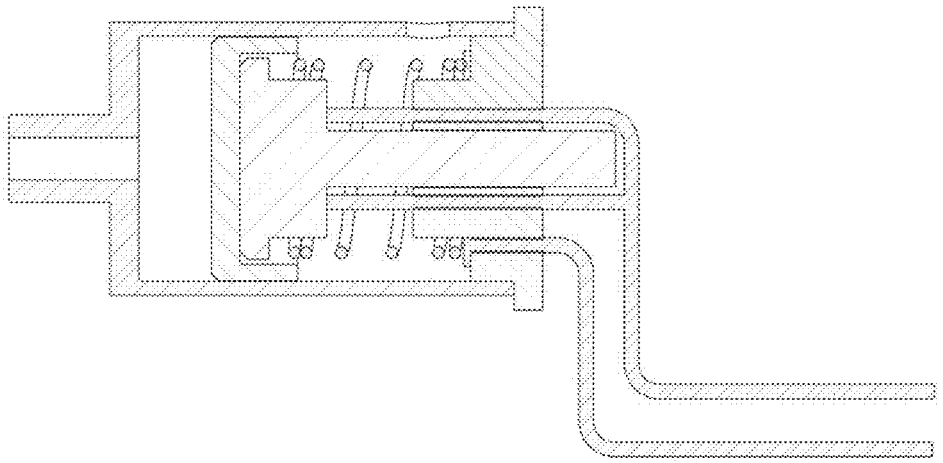
FIG. 8 is a sectional view of an oil level sensor according to the embodiment of the disclosure, showing the oil level sensor in an ON status.

FIG. 6 is a front view of an oil level sensor according to the embodiment of the present disclosure, wherein the housing of the oil level sensor is not shown in the figure. FIG. 7 is a sectional view of an oil level sensor according to the embodiment of the present disclosure, showing the oil level sensor in an OFF state. FIG. 8 is a sectional view of an oil level sensor according to the embodiment of the present disclosure, showing the oil level sensor in an ON state.

As shown in FIGS. 6 to 8, the oil level sensor 120 may include an approximately cylindrical housing 121, a piston cap 123 movable axially in the housing 121, a piston head 125 moving with the piston cap 123, a terminal plug 126 closing an end of the housing 121, a first contact 127 and a second contact 128 provided in the terminal plug 126 and a return spring provided between the piston head 125 and the terminal plug 126. A fluid inlet 122 is provided on a side wall of an end of the housing 121 opposing to the terminal plug 126 and a discharge outlet 124 is formed on a side wall of the shell 121. During the axial movement of the piston head 125, fluid between the piston head 125 and the terminal plug 126 is discharged through the discharge outlet 124 to reduce resistance to the supplied fluid. A piston rod 125*a* of the piston head 125 extends through a through hole 131 formed in the terminal plug 126 and is movable axially in the through hole 131. The first contact 127 may include a plurality of pins 127A and 127B spaced with each other but connected with each other. In the example of the figures, the first contact 127 includes two pins 127A and 127B, however, those skilled in the art should understand that, the first contact 127 may include only one pin or more than two pins. The second contact 128 may include an annular contact lug 128A. The annular contact lug 128A is provided on a step of the terminal plug 126. The return spring 129 is connected electrically with the annular contact lug 128A of the second contact 128 and the piston head 125. Besides, as shown in FIG. 2, the first contact 127 and the second contact 128 of the oil level sensor 120 lead to the outside of the compressor through an adaptor 150 provided on the shell 12.

As shown in FIG. 7, when there is no fluid supplied to the inlet 122 of the oil level sensor 120, the piston head 125, under the action of the return spring 129, moves toward a direction opposing to the first contact 127 and the second contact 128, so as to disconnect the first contact 127 and the second contact 128. Meanwhile, the oil level sensor 120 outputs no signals, or outputs a signal "0".

As shown in FIG. 8, when fluid is supplied to the inlet 122 of the oil level sensor 120, the piston head 125, pushed by the fluid supplied, overcomes the force of the return spring 129 and moves towards the first contact 127 and the second contact 128. When the piston head 125 contacts any one of the pins of the first contact 127, the first contact 127 and the second contact 128 can be connected electrically. Then, the oil level sensor 120 outputs an ON signal, or outputs a signal "1".

A specific oil level sensor is illustrated in FIGS. 6 to 8. It should be appreciated by those skilled in the art that, the oil level sensor may be any kind of sensor including a fluid pressure receiving portion for receiving pressure of fluid and a converting portion for converting the pressure of fluid into an electric signal.

Hereinafter, the process of detecting lubricating oil in the rotary compressor according to the embodiment of the present disclosure will be described. When there is a proper amount of lubricating oil in the shell 12 of the compressor, lubricating oil entering into the concentric hole 54 of the rotary shaft 50, under the action of centrifugal force, forms a paraboloid P as shown in FIG. 3. Then, the lubricating oil flows into the fluid inlet 122 of the oil level sensor 120 through the pressure picking hole 112 on the side wall of the rotary shaft, the circumferential oil groove 114 formed in the lower bearing housing 70 and the communicating channel 116 in the lower bearing housing 70. As described above, the piston head 125, being pushed by the lubricating oil, moves towards the first contact 127 and the second contact 128 and connect electrically the first contact 127 and the second contact 128 finally, so as to output the signal "1" which indicates that there is a proper amount of lubricating oil in the compressor. In contrary, if there is no sufficient amount of lubricating oil in the shell 12 of the compressor, no lubricating oil arrives at the inlet 122 of the oil level sensor 120, therefore, the oil level sensor 120 outputs the signal "0" which indicates that there is no sufficient amount of lubricating oil in the compressor.

In order to detect the lubricating oil level in the compressor more accurately, a pressure picking pipe 118 protruding towards an axis of the concentric hole 54 may be disposed in the pressure picking hole 122 on a side wall of the rotary shaft. A lubricating oil level to be detected may be controlled by the length of the pressure picking pipe 118 protruding inwardly (for example, the length L shown in FIGS. 9 and 11). As shown in FIG. 3, when a distal end 119 of the pressure picking pipe 118 is located within the oil surface denoted by the paraboloid P, lubricating oil is capable of flowing into the pressure picking pipe 118. During the movement along the pressure picking pipe 118, kinetic energy of the lubricating oil can be converted into the pressure, thereby a certain pressure difference is produced between the both ends of the pressure picking pipe 118. When lubricating oil with a certain pressure flows into the oil level sensor 120, the piston head 125 of the oil level sensor 120 is pushed thereby connecting electrically the first contact 127 and the second contact 128, and thus the sensor outputs the signal "1". If the distal end 119 of the pressure picking pipe 118 is located outside the oil surface donated by the paraboloid P, lubricating oil cannot flow into the oil level sensor 120 and thus the sensor outputs the signal "0". Accordingly, when a lubricating oil level to be detected (i.e. a lowest protection lubricating oil level) is set higher, a longer pressure picking pipe 118 may be used, while when a lubricating oil level to be detected (i.e. a lowest protection lubricating oil level) is set lower, a shorter pressure picking pipe 118 may be used. Particularly, the relationship between the lowest protection lubricating oil level and a length of the pressure picking pipe 118 when the compressor is operated in a certain working state may be determined by calculation or experiment.

Figure 11:
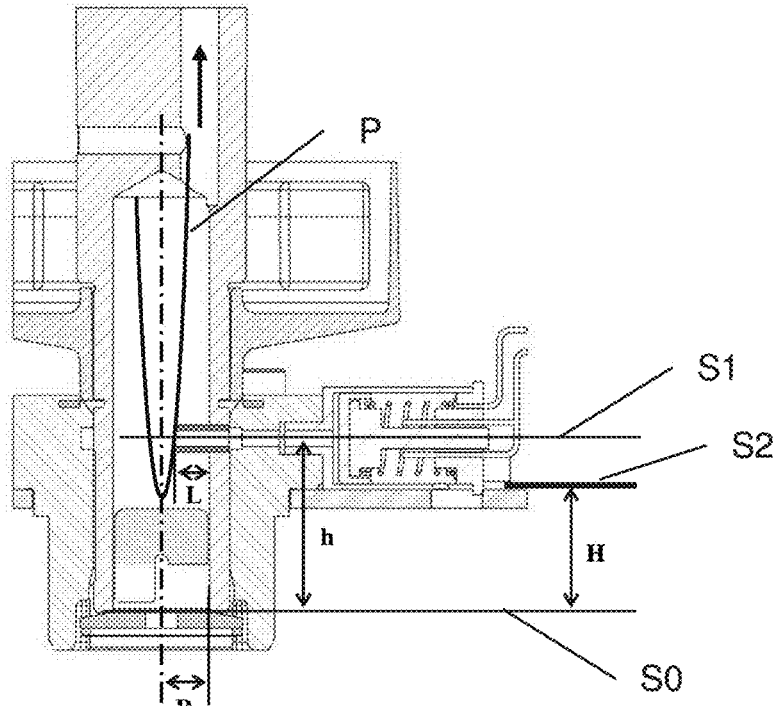
FIG. 11 illustrates the relationships among a lowest protection lubricating oil level, an inner radius of the rotary shaft, height of a pressure picking pipe and length of the pressure picking pipe.
Figure 12:
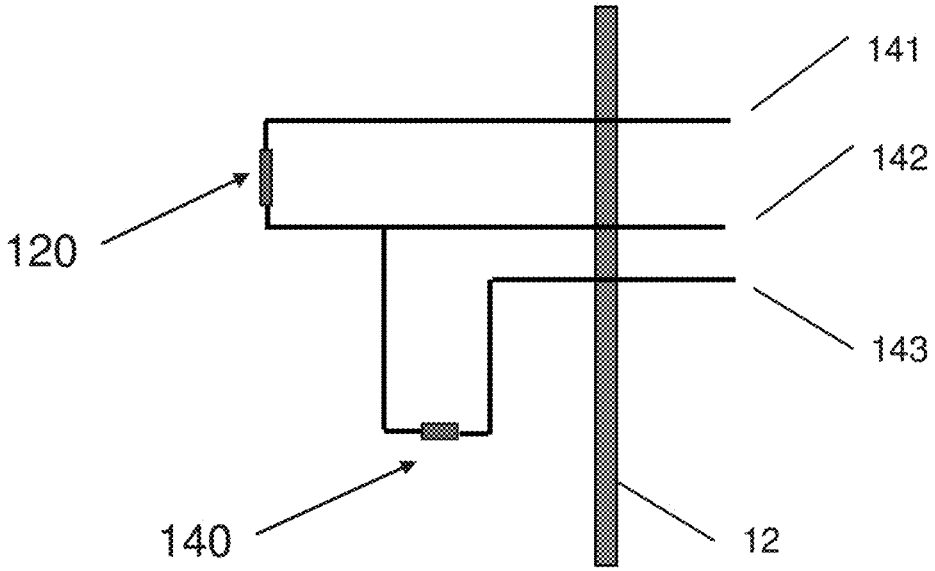
FIG. 12 is a schematic diagram of an oil level detecting mechanism according to still another embodiment of the disclosure.

Specifically referring to FIG. 11, the lower protection lubricating oil level and the length of the pressure picking pipe 118 may satisfy the following equation:

$$H = h - \frac{(R-L)^2 \cdot \left(\frac{n}{60} \cdot 2\pi\right)^2}{2000 \cdot g},$$

wherein, H [mm] is a height of the lowest protection lubricating oil level from an end face S0 of the rotary shaft 50;

L [mm] is a length of the pressure picking pipe 118 protruded into the rotary shaft 50;

R [mm] is an inner radius of the rotary shaft 50;

h [mm] is a height of a center axis of the pressure picking pipe 118 from the end face S0 of the rotary shaft 50;

n [rpm] is the number of revolution of the rotary shaft; and g [$m/s^2$] is the acceleration of gravity.

According to the above equation, for example, if h=32 mm, L=6.9 mm, n=2000 rpm, R=9 mm, g=9.81 $m/s^2$, then H≈22 mm. That is, when the number of revolution of the rotary shaft is 2000 rpm and the length of the pressure picking pipe protruded into the rotary shaft is 6.9 mm, the lowest protection lubricating oil level that can be detected by the oil level sensor is about 22 mm. That is, when the lubricating oil level in the oil sump is higher than 22 mm, the oil level sensor can output the signal "1", indicating that the compressor can operate normally. And when the lubricating oil level in the oil sump is lower than 22 mm, the oil level sensor cannot output the signal "1" (i.e. it outputs the signal "0"), indicating that there is no sufficient lubricating oil in the compressor, then a compressor protection mechanism would shut off the compressor.

Figure 9:
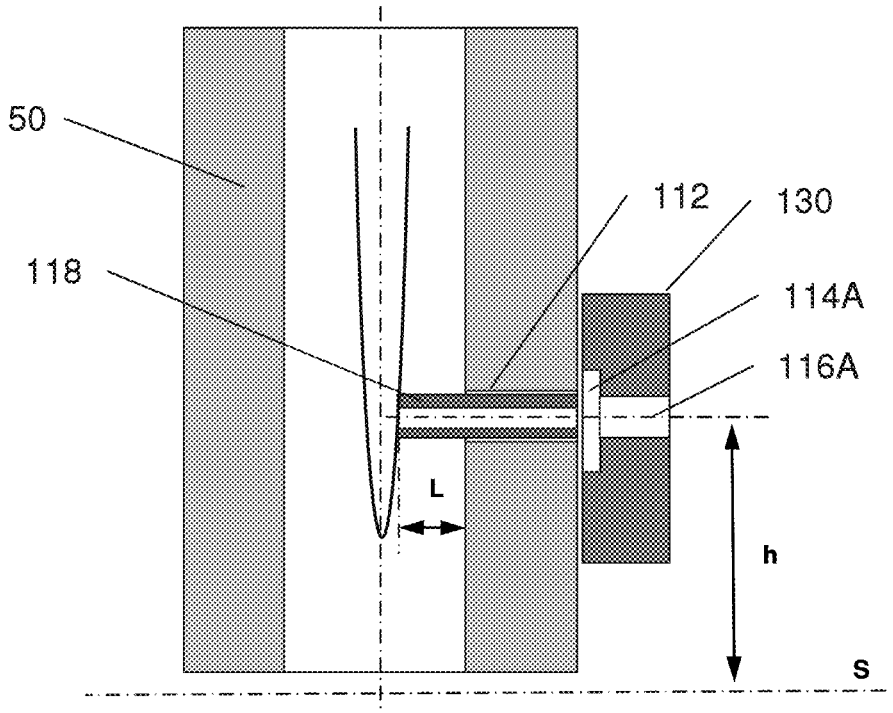
FIG. 9 is a schematic diagram of an oil level detecting mechanism according to another embodiment of the disclosure.

Except the method of providing the pressure picking pipe mentioned above, a lubricating oil level in the compressor may be detected more accurately by adjusting the height h of the pressure picking hole 112 from a certain reference surface (for example, the reference surface S in FIG. 9, it may be a bottom surface of the compressor, and also may be an end surface S0 of the rotary shaft 50). In particularly, when a lubricating oil level to be detected (i.e. a lowest protection oil level) is set higher, the height of the pressure picking hole 112 from a certain reference surface may be set higher, and when a lubricating oil level to be detected (i.e. a lowest protection oil level) is set lower, the height of the pressure picking hole 112 from a certain reference surface may be set lower. Specifically, the relationship between a lubricating oil level to be detected and a height of the pressure picking hole 112 from a certain reference surface when the compressor is operated in a certain working state may be determined by calculation or experiment.

Figure 10:
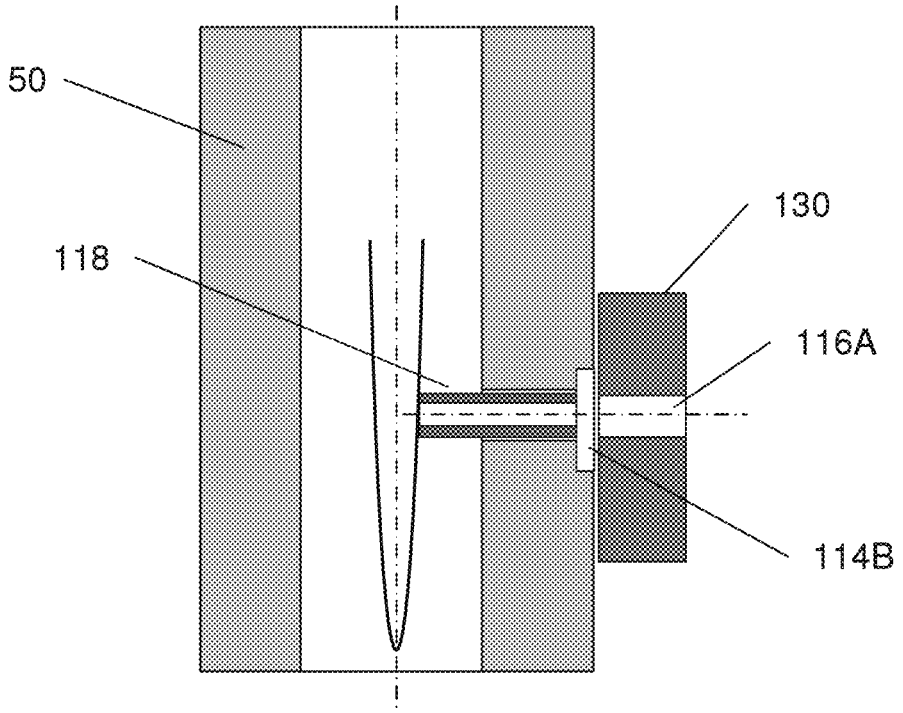
FIG. 10 is a schematic diagram of a variant of the oil level detecting mechanism according to another embodiment of the disclosure.

In the example shown in FIG. 3, the pressure picking passage 110 includes a pressure picking hole 112 provided on a side wall of the rotary shaft, a circumferential oil groove 114 provide in a lower bearing housing 70, a communicating channel 116 extending through the lower bearing housing 70, and optionally includes a pressure picking pipe 118 provided in the pressure picking hole 112. However, the configuration of the pressure picking passage 110 is not limited to what described herein, but can have various variants. For example, the circumferential oil groove 112 may be provided on the rotary shaft 50, rather than provided on the lower bearing housing 70. In addition, for example, as shown in FIGS. 9 and 10, a pressure picker 130 may further be provide between the rotary shaft 50 and the oil level sensor 120. In the example shown in FIG. 9, the pressure picker 130 is an annular element and includes a circumferential oil groove 114A in fluid communication with the pressure picking hole 112 on the rotary shaft 50 and a communicating channel 116A in fluid communication with the circumferential oil groove 114A and extending through the pressure picker 130. In the example shown in FIG. 10, a circumferential oil groove 114B may be disposed on the rotary shaft 50. The fluid inlet 122 of the oil level sensor 120 may be in fluid communication with the communicating channel 116A of the pressure picker 130 directly or through other pipelines. The oil level sensor 120 may be arranged more flexibly by providing the pressure picker 130, and the configuration of the lower bearing housing 70 needn't be modified.

In an example of the oil level detecting mechanism according to the present disclosure shown in FIG. 11, an oil temperature sensor 140 may be provided further. The oil temperature sensor 140 and the oil level sensor 120 may use a common lead wire 142. In particularly, lead wires 141 and 142 output signals of the oil level sensor 120, and lead wires 142 and 143 output signals of the oil temperature sensor. In this embodiment, the compressor may be controlled not only based on signals of the oil level sensor 120 but also based on signals of the oil temperature sensor 140. Thus it provides double protection for the compressor.

In the embodiments shown in the figures, the oil level detecting mechanism 100 is in fluid communication with the concentric hole 54. However, it should be understood by those skilled in the art that, the concentric hole 54 may be replaced by an eccentric hole extending axially along the rotary shaft 50. Besides, basing on the inner design of the compressor, the oil level detecting mechanism 100 may be in fluid communication with the eccentric hole 56 of the rotary shaft 50. Even if the holes 54 and 56 are all eccentric holes, the oil level detecting mechanism of the disclosure still can operate normally because of the centrifugal force caused by rotation of the rotary shaft.

In the embodiments of the disclosure, an oil level sensor including a piston, contacts and a spring is described. Those skilled in the art should understand that, any suitable pressure sensor known in the art, specifically a pressure switch, may be used as the oil level sensor.

Figure 13A:
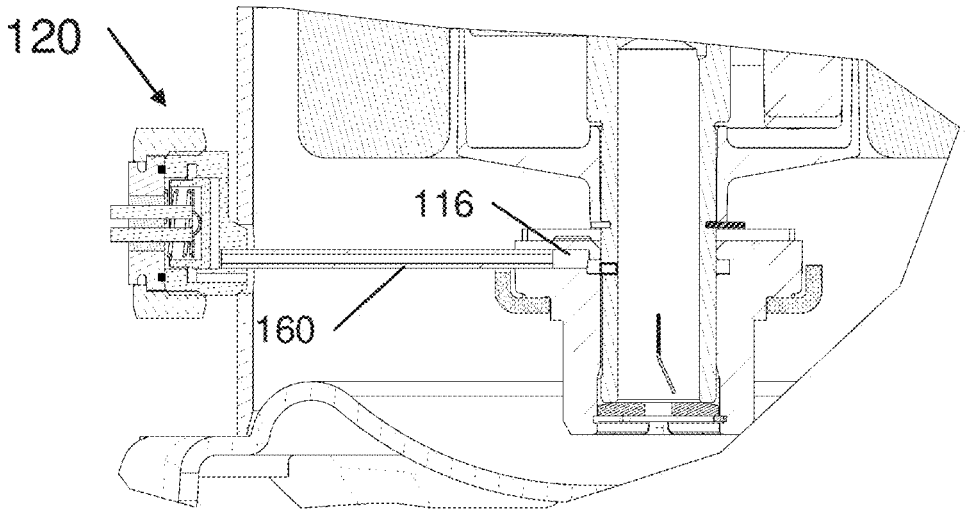
FIGS. 13A and 13B are schematic sectional views of a lower portion of the rotary compressor according to a further embodiment of the disclosure.
Figure 13B:
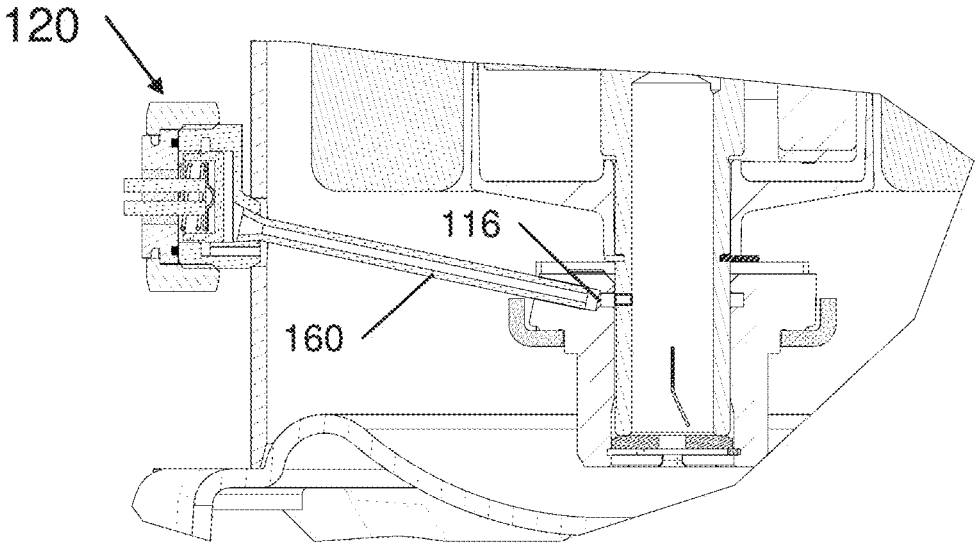

In the embodiments mentioned above, the oil level sensor 120 is illustrated to be disposed in the shell 12 and can be in fluid communication with the communicating channel 116 in the lower bearing housing 70 or the communicating channel 116A in the pressure picker 130 directly or by an additional pipeline. However, the present disclosure is not limited to what is described herein. As shown in FIGS. 13A and 13B, the oil level sensor 120 may be provided outside the shell 12 and in fluid communication with the communicating channel 116 in the lower bearing housing 70 (or a communicating channel in the pressure picker) through the connecting pipe 160. The connecting pipe 160 may be arranged horizontally (as shown in FIG. 13A) or be arranged obliquely (as shown in FIG. 13B). With this kind of configuration, the various components within the compressor can be arranged more flexibly.

While various embodiments of the present disclosure have been described in detail herein, it should be understood that the present disclosure is not limited to the specific embodiments described in detail and illustrated herein, those skilled in the art can make other variants and modifications without departing from the principle and scope of the present disclosure. All these variants and modifications fall into the scope of the present disclosure. Furthermore, all the elements described herein can be replaced by the other technically equivalent elements.

What is claimed is:

1. A rotary compressor, comprising:

a shell including an oil sump for receiving lubricating oil;

a compressing mechanism disposed in the shell;

a driving mechanism for driving the compressing mechanism, wherein the driving mechanism includes a rotary shaft provided therein, the rotary shaft having a through hole extending in an axial direction therein and being in fluid communication with the oil sump via the through hole; and an oil level sensor in fluid communication with the through hole in the rotary shaft through a pressure picking passage such that lubricating oil can flow from the through hole in the rotary shaft through the pressure picking passage to the oil level sensor, wherein the oil level sensor is adapted to sense a level of lubricating oil in the oil sump in response to a pressure of the lubricating oil, wherein the pressure picking passage further includes a pressure picking pipe disposed in the pressure picking passage that selectively permits the flow of the lubricating oil to the oil level sensor based on a pressure of the lubricating oil.

2. The rotary compressor according to claim 1, further comprising a lower bearing housing for supporting the rotary shaft, wherein the pressure picking passage comprises:

a pressure picking hole extending through a side wall of the rotary shaft and in fluid communication with the through hole in the rotary shaft, a circumferential oil groove formed on the rotary shaft or the lower bearing housing and in fluid communication with the pressure picking hole, and a communicating channel extending through the lower bearing housing and in fluid communication with the circumferential oil groove and the oil level sensor.

3. The rotary compressor according to claim 2, wherein the pressure picking pipe is disposed in the pressure picking hole and protruded toward an axis of the through hole in the rotary shaft.

4. The rotary compressor according to claim 3, wherein a length of the pressure picking pipe is determined according to a lowest protection lubricating oil level in the oil sump.

5. The rotary compressor according to claim 4, wherein the higher the lowest protection lubricating oil level is set, the longer the length of the pressure picking pipe is set.

6. The rotary compressor according to claim 4, the lowest protection lubricating oil level and the length of the pressure picking pipe satisfy the following equation:

$$H = h - \frac{(R-L)^2 \cdot \left(\frac{n}{60} \cdot 2\pi\right)^2}{2000 \cdot g},$$

wherein, H [mm] is a height of the lowest protection lubricating oil level from an end face of the rotary shaft;

L [mm]—a length of the pressure picking pipe protruded into the rotary shaft (50);

R [mm]—an inner radius of the rotary shaft;

h [mm]—a height of a center axis of the pressure picking pipe from the end face of the rotary shaft;

n [rpm]—the number of revolution of the rotary shaft; and g [$m/s^2$]—the acceleration of gravity.

7. The rotary compressor according to claim 2, wherein a height of the pressure picking hole from a certain reference surface is determined according to a lowest protection lubricating oil level in the oil sump.

8. The rotary compressor according to claim 7, wherein the higher the lowest protection lubricating oil level is set, the higher the height of the pressure picking hole is set.

9. The rotary compressor according to claim 7, wherein the reference surface is a bottom surface of the rotary compressor or an end surface of the rotary shaft.

10. The rotary compressor according to claim 2, wherein the oil level sensor is provided to be closer to the lower bearing housing than a main bearing housing.

11. The rotary compressor according to claim 2, wherein the oil level sensor is directly connected with the communicating channel in the lower bearing housing.

12. The rotary compressor according to claim 2, wherein the oil level sensor is connected with the communicating channel in the lower bearing housing through an additional pipeline.

13. The rotary compressor according to claim 2, wherein the oil level sensor is disposed inside the shell.

14. The rotary compressor according to claim 2, wherein the oil level sensor is disposed outside the shell.

15. The rotary compressor according to claim 14, wherein the pressure picking passage further comprises a connecting pipe in fluid communication with the communicating channel in the lower bearing housing.

16. The rotary compressor according to claim 15, wherein the connecting pipe is arranged horizontally or obliquely.

17. The rotary compressor according to claim 1, further comprising a pressure picker disposed between the rotary shaft and the oil level sensor, wherein the pressure picking passage comprises:

a pressure picking hole extending through a side wall of the rotary shaft and in fluid communication with the through hole in the rotary shaft, a circumferential oil groove formed on the rotary shaft or the pressure picker and in fluid communication with the pressure picking hole, and a communicating channel extending through the pressure picker and in fluid communication with the circumferential oil groove and the oil level sensor.

18. The rotary compressor according to claim 17, wherein the oil level sensor is directly connected with the communicating channel in the pressure picker.

19. The rotary compressor according to claim 17, wherein the oil level sensor is connected with the communicating channel in the pressure picker through an additional pipeline.

20. The rotary compressor according to claim 17, wherein the oil level sensor is disposed outside the shell.

21. The rotary compressor according to claim 20, wherein the pressure picking passage further comprises a connecting pipe in fluid communication with the communicating channel in the pressure picker.

22. The rotary compressor according to claim 1, further comprising an oil pumping mechanism, wherein the oil pumping mechanism includes a plate with a hole provided at an end of the rotary shaft and an oil fork provided in the through hole of the rotary shaft.

23. The rotary compressor according to claim 1, further comprising an oil pumping mechanism, wherein the oil pumping mechanism includes a vane pump provided at an end of the rotary shaft.

24. The rotary compressor according to claim 1, wherein the rotary compressor is a horizontal rotary compressor and an inner space of the rotary compressor is divided into high side acting as the oil sump and low side by a muffler plate, and wherein the rotary compressor further comprises an oil pumping mechanism, and the oil pumping mechanism is an oil pipe extending from the oil sump to the through hole in the rotary shaft.

25. The rotary compressor according to claim 1, wherein the through hole comprises a concentric hole portion which is concentric with respect to the rotary shaft and an eccentric hole portion which is offset radially with respect to the concentric hole.

26. The rotary compressor according to claim 1, wherein the oil level sensor is a pressure sensor.

27. The rotary compressor according to claim 1, wherein the oil level sensor is a pressure switch.

28. The rotary compressor according to claim 1, wherein the oil level sensor comprises:

a fluid pressure receiving portion for receiving pressure of fluid, and a converting portion for converting the pressure of fluid into an electrical signal.

29. The rotary compressor according to claim 28, wherein the fluid pressure receiving portion comprises: a housing; and a piston head which is movable axially in the housing;

wherein the converting portion comprises: a terminal plug; a first contact and a second contact provided in the terminal plug; and a spring for providing electrical connection between the piston head and the second contact and providing return force for the piston head, and wherein the oil level sensor outputs the electrical signal when the piston head contacts the first contact.

30. The rotary compressor according to claim 29, wherein the first contact comprises a plurality of pins which are spaced with each other.

31. The rotary compressor according to claim 29, wherein the second contact comprises an annular contact lug electrically contacted with the spring.

32. The rotary compressor according to claim 1, further comprising an oil temperature sensor.

33. The rotary compressor according to claim 32, wherein the oil temperature sensor and the oil level sensor have a common lead wire.

34. The rotary compressor according to claim 1, wherein the rotary compressor is a scroll compressor, or a screw compressor, or a rotor compressor.

35. A rotary machine, comprising:

a shell including an oil sump for receiving lubricating oil;

a rotary shaft disposed in the shell, the rotary shaft having a through hole extending in an axial direction therein and being in fluid communication with the oil sump via the through hole; and an oil level sensor in fluid communication with the through hole in the rotary shaft through a pressure picking passage such that lubricating oil can flow from the through hole in the rotary shaft through the pressure picking passage to the oil level sensor, wherein the oil level sensor is adapted to sense a level of lubricating oil in the oil sump in response to a pressure of the lubricating oil, wherein the pressure picking passage further includes a pressure picking pipe disposed in the pressure picking passage that selectively permits the flow of the lubricating oil to the oil level sensor based on a pressure of the lubricating oil.

36. The rotary machine according to claim 35, further comprising a bearing housing for supporting the rotary shaft, wherein the pressure picking passage comprises a pressure picking hole extending through a side wall of the rotary shaft and in fluid communication with the through hole in the rotary shaft, a circumferential oil groove formed on the rotary shaft or the bearing housing and in fluid communication with the pressure picking hole, and a communicating channel extending through the bearing housing and in fluid communication with the circumferential oil groove and the oil level sensor.

37. The rotary machine according to claim 35, further comprising a pressure picker disposed between the rotary shaft and the oil level sensor, wherein the pressure picking passage comprises a pressure picking hole extending through a side wall of the rotary shaft and in fluid communication with the through hole in the rotary shaft, a circumferential oil groove formed on the rotary shaft or the pressure picker and in fluid communication with the pressure picking hole, and a communicating channel extending through the pressure picker and in fluid communication with the circumferential oil groove and the oil level sensor.

* * * * *